US008303428B2

(12) United States Patent
Wagen et al.

(10) Patent No.: US 8,303,428 B2
(45) Date of Patent: Nov. 6, 2012

(54) SHORT GAME TRAINING DEVICE FOR USE WITH GOLF CLUB

(76) Inventors: Thomas A. Wagen, San Ramon, CA (US); Lewis C. Knapp, Santa Cruz, CA (US)

( * ) Notice: Subject to any disclaimer, the term of this patent is extended or adjusted under 35 U.S.C. 154(b) by 1209 days.

(21) Appl. No.: 12/032,607

(22) Filed: Feb. 15, 2008

(65) Prior Publication Data

US 2008/0200275 A1 Aug. 21, 2008

Related U.S. Application Data

(60) Provisional application No. 60/901,896, filed on Feb. 15, 2007.

(51) Int. Cl.
*A63B 57/00* (2006.01)

(52) U.S. Cl. ..... 473/224; 473/219; 473/221; 473/223; 473/257

(58) Field of Classification Search ..... 473/219, 473/221, 223, 224, 226, 227, 257
See application file for complete search history.

(56) References Cited

U.S. PATENT DOCUMENTS 3,945,646 A * 3/1976 Hammond ..... 473/223
5,277,428 A * 1/1994 Goodwin et al. ..... 473/224
5,688,183 A * 11/1997 Sabatino et al. ..... 473/212
5,836,829 A * 11/1998 Van Cott et al. ..... 473/224
6,441,745 B1 * 8/2002 Gates ..... 340/669
6,607,450 B1 * 8/2003 Hackman ..... 473/223
6,648,769 B2 * 11/2003 Lee et al. ..... 473/223
7,815,516 B1 * 10/2010 Mortimer et al. ..... 473/257
2005/0288119 A1 * 12/2005 Wang et al. ..... 473/223
2006/0063600 A1 * 3/2006 Grober ..... 473/224
2006/0084516 A1 * 4/2006 Eyestone et al. ..... 473/219
2009/0131190 A1 * 5/2009 Kimber ..... 473/222

* cited by examiner

*Primary Examiner* — Melba Bumgarner
*Assistant Examiner* — Lawrence Galka
(74) *Attorney, Agent, or Firm* — Brian Beverly; Beeson Skinner Beverly, LLP

(57) ABSTRACT

A short game training device 10 for use with a golf club comprises an two-axis linear accelerometer 12, a fastener 50 for removably attaching the accelerometer to the golf club head H so that the X and Y axes of the accelerometer 12 are disposed approximately parallel with the club face and oriented at approximately a forty-five degree angle with respect to a substantially vertical plane V containing the aim line A established when addressing the golf ball G with the club face aligned perpendicularly to the aim line A, a detectable alarm 18, and a microprocessor 14 for calculating differences in forces measured by the X and Y axes during a timed interval subsequent to positioning the club and for activating the alarm 18 when the differences exceed a selected threshold.

28 Claims, 13 Drawing Sheets

Down

| Motion | X Axis | Y Axis |
|---|---|---|
| Right | – | + |
| Left | + | – |
| Down | – | – |

FIG. 8A
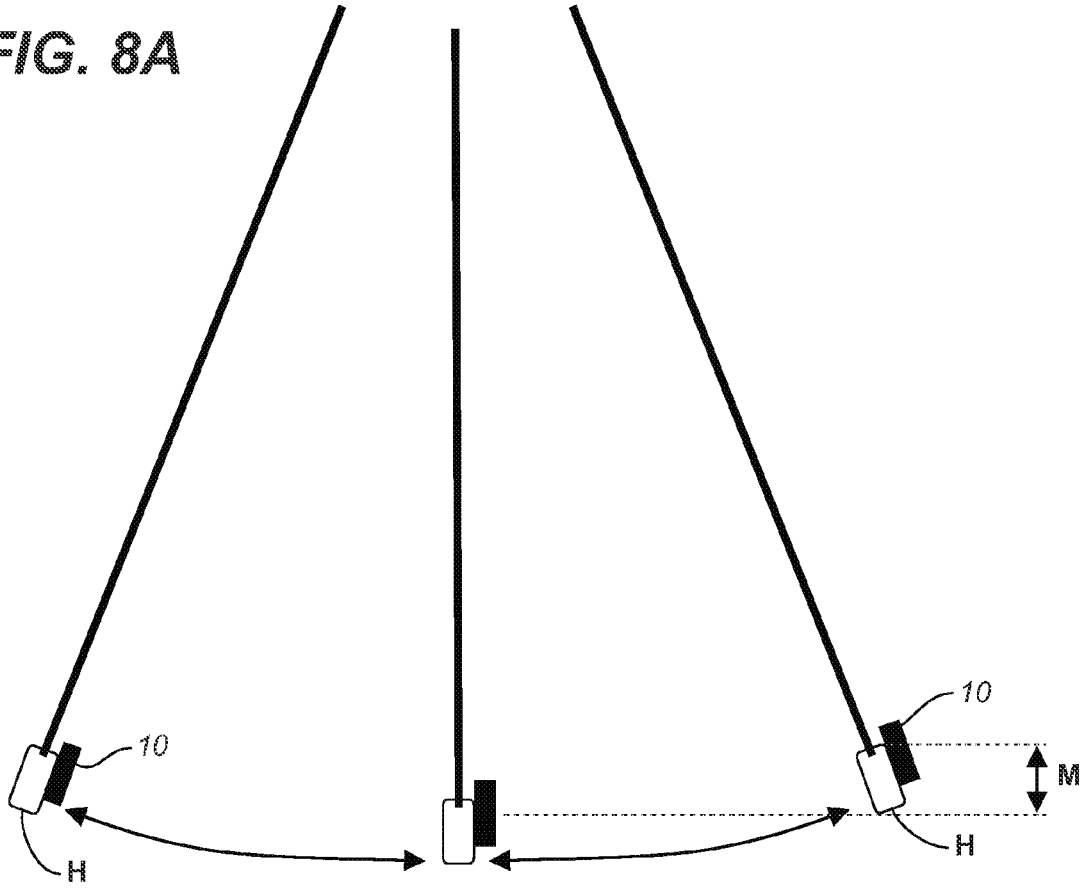
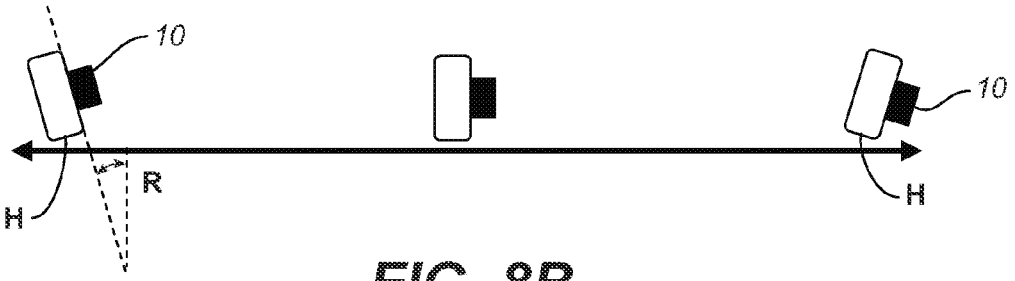
FIG. 8B

SHORT GAME TRAINING DEVICE FOR USE WITH GOLF CLUB

CROSS-REFERENCE TO RELATED APPLICATIONS

This application claims the benefit of U.S. Provisional Application No. 60/901,896, filed Feb. 15, 2007.

BACKGROUND

1. Field of the Invention

This invention relates to training devices for practicing golf swings, particularly to a short game training device for developing accurate short game stroke techniques for the game of golf.

2. Description of the Related Art

It is estimated that in every round, many golfers will lose 6 or more "savable" strokes to par on or near the greens. Dropping a few extra putts, getting chip shots close enough to one-putt, and avoiding three-putt greens is usually the difference between a bad, good, or great round of golf. The best way for players to establish and sustain a lower handicap is to improve short game performance. While many products are available to improve a player's golf game, almost every training aid is meant for the "long" game, calling for shots that require the player to make a full swing with the club.

When putting, the club face must be square to the aim line at impact because a straight and vertical ball roll enables the player to best match the path of the ball with the aim line. Even if aim is true, a stroke that does not consistently square the club face with the aim line at impact will produce off-line putts due to side spin. The same is true for chip shots. Spin alters the direction of the ball as it rolls due to friction with the surface of the green and contributes significantly to inconsistent results. For example, a right-handed player striking the ball with a "closed" club face, that is, rotated counter-clockwise about a vertical axis, will generate a counter-clockwise spin that will move the ball to the left. Many players try to compensate for a closed or "open" (rotated clockwise about a vertical axis) club face by adjusting their stroke path, usually in mid-stroke by deviating from the aim line.

Few players have a naturally good "short" game. In golf the short game is generally understood to include putting on the green, chip shots which originate approximately 15 yards away from the hole and require less than half of a full swing of the golf club, and pitch shots which originate between 15 to 40 yards from the hole. The best players literally practice putting and chipping for hundreds of hours to develop a proficient and dependable short game. Maintaining proficiency requires continued dedication and most players are limited in the time available to practice their short game. There is, therefore, a need for a training device to assist golfers in practicing their short game and to make more productive use of available practice time.

BRIEF DESCRIPTION OF THE ILLUSTRATIONS

FIG. 8A is an elevational representation of a golf club passing through an arced swing.

FIG. 8B is a plan view a golf club passing through the arced swing shown in FIG. 8A.

DETAILED DESCRIPTION OF THE ILLUSTRATED EMBODIMENT

Figure 1B:
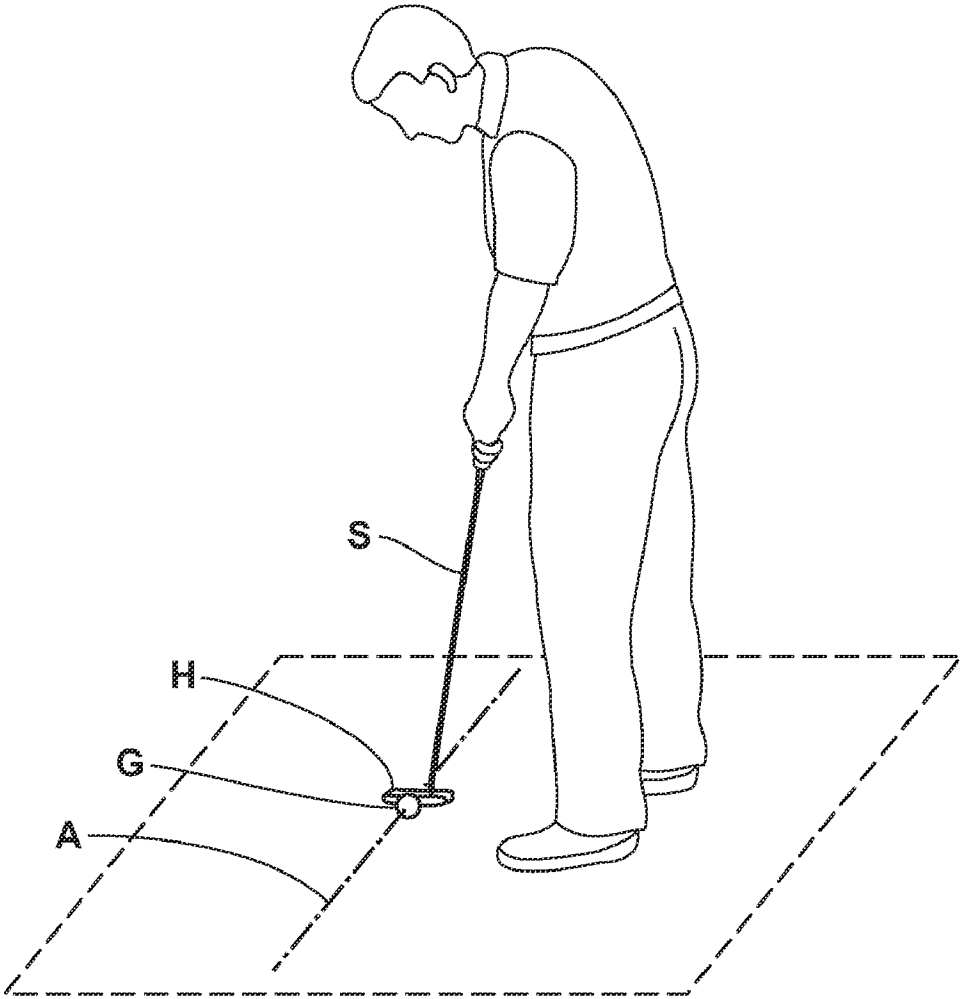
FIG. 1B is a perspective view of a golfer addressing a golf ball along a selected aim line.
Figure 1A:
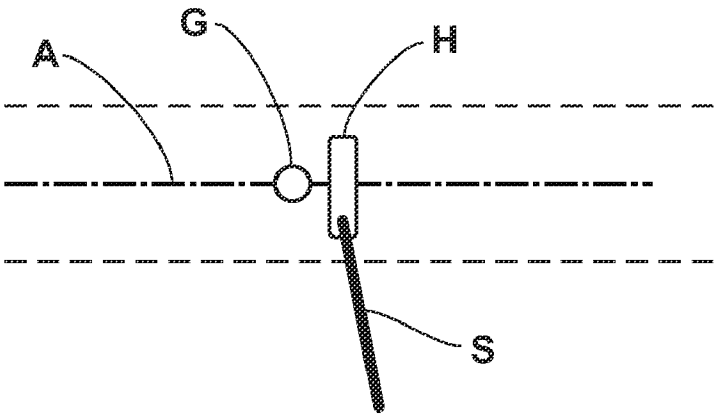
FIG. 1A is a plan view of a golf club head and shaft with the golf club aligned adjacent a golf ball as when addressing the ball in preparation for a stroke.

In preparation for putting, chipping or a pitch shot, the player addresses the ball G as shown in FIGS. 1A and 1B by positioning the club head H adjacent the ball with the club face as nearly perpendicular to "aim line" A which has been carefully selected by the player. A straight putt depends strongly on the club head H striking the ball G in a manner which results in transfer of momentum to the ball along the aim line A. It is widely recognized that there are several factors which can adversely affect a player's short game. These include improper club face alignment, commonly referred to as "closed" or "open" club face, deviation in the club path on the back or "take-away" stroke from the aim line, deviation of the club from the aim line during the down stroke, and deviation of the club from the aim line during the follow-through stroke. Professional and other committed golfers will devote hundreds of hours to perfecting these stroke mechanics in order to improve their short game. The short game trainer is designed to help the player correct these problems and increase his or her short game proficiency.

Figure 2A:
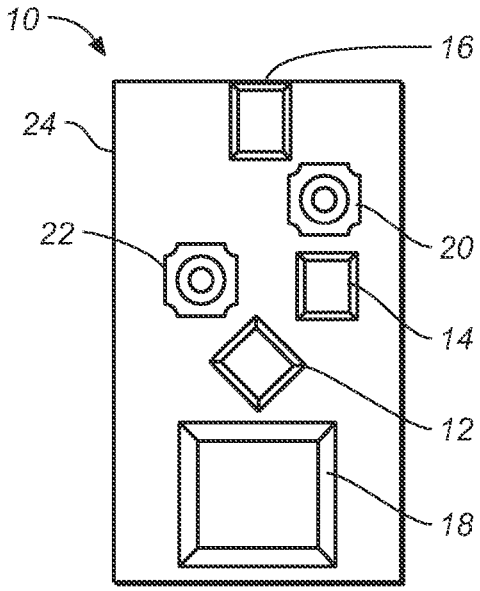
FIG. 2A is a schematic representation of a short game training device according to the invention.
Figure 2B:
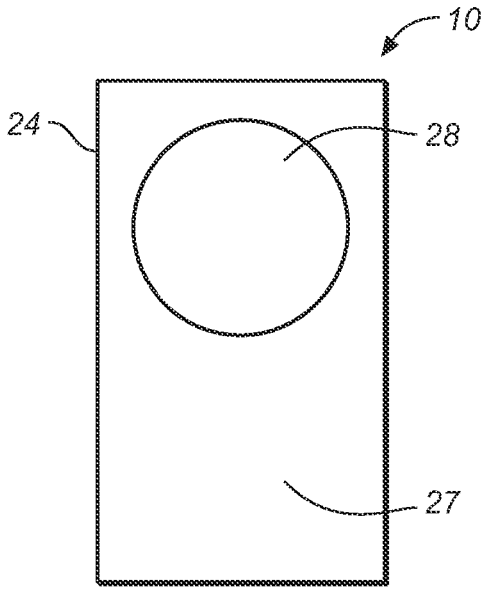
FIG. 2B is a schematic representation of the back side of the short game training device depicted in FIG. 2A.
Figure 3:
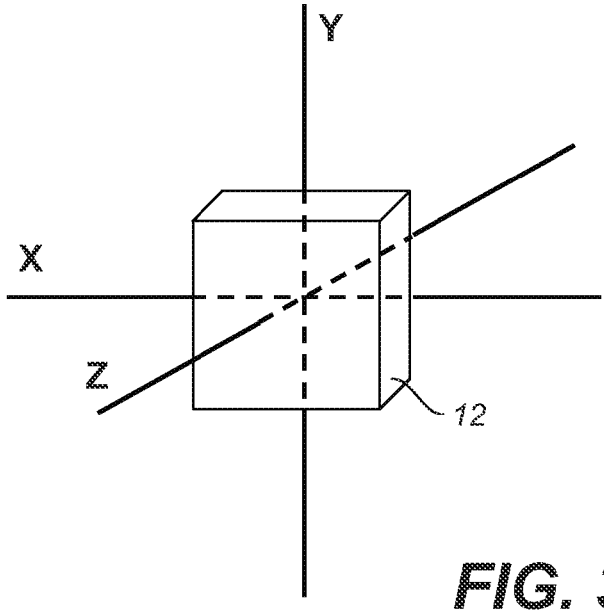
FIG. 3 is a schematic representation of a three axis linear accelerometer.
Figure 4B:
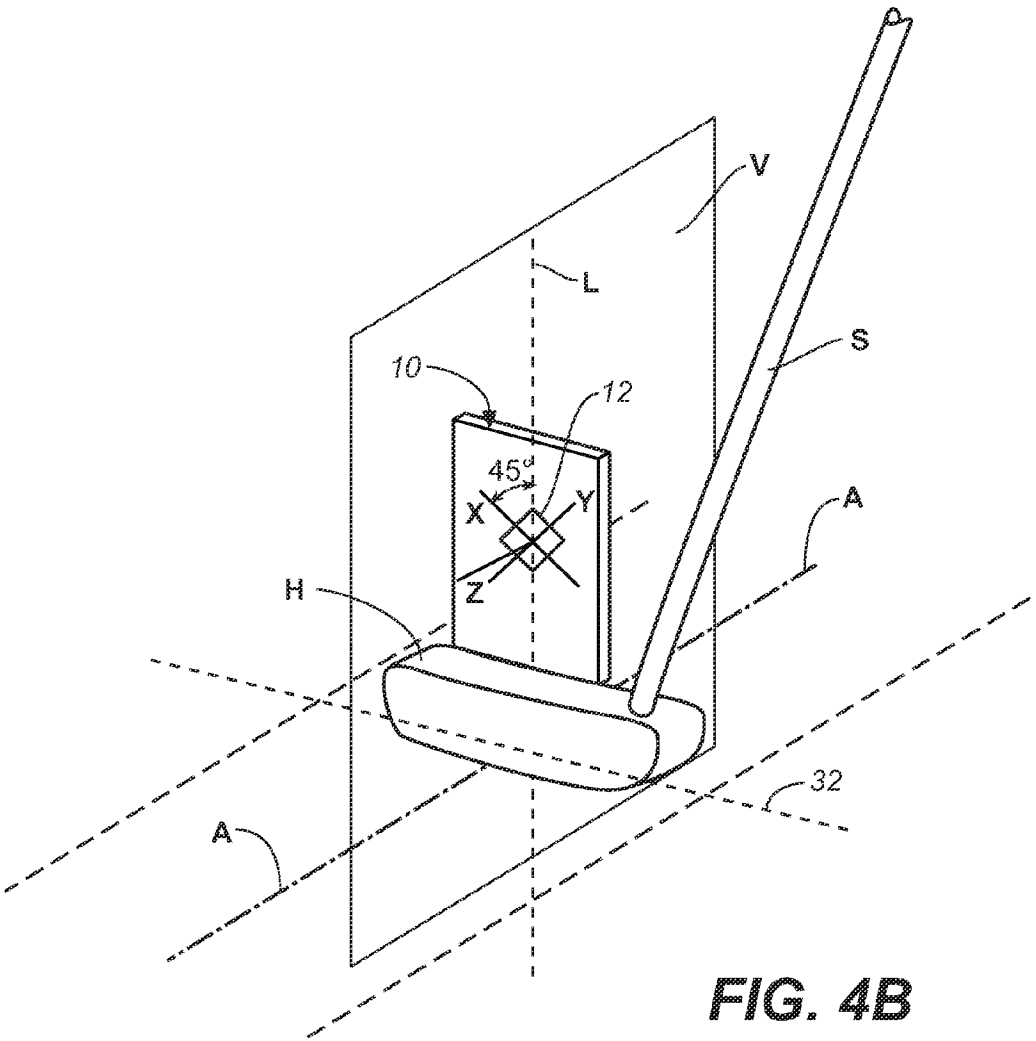
FIG. 4B is a perspective view of a golf club, with a short game training device attached to the club head thereof, showing the club head positioned at the address line.

A short game training device for use with a golf club according to the invention is indicated generally at 10 in FIG. 4. With reference to FIGS. 2A and 2B, the device comprises an accelerometer 12, a microprocessor 14, a status light 16, a speaker or a wireless audio or data transmitter subsystem 18, a mode button 20, and an on/reset button 22 mounted on the front side of a circuit board 24. A battery 28 is provided on the rear side 27 of the circuit board 24. The accelerometer 12 used in the device is a solid state MEMS 3-axis linear accelerometer having X, Y, and Z orthogonal axes, as shown in FIG. 3. The accelerometer measures force registering in each axis as a function of both the magnitude of acceleration of the accelerometer and the angle between the direction of the acceleration and the sensing axis. Since force can be understood as a vector quantity, having both magnitude and direction, a three-axis accelerometer, in effect, allows measurement of a net force decomposed into three orthogonal component vectors. One problem with measurement of forces using linear accelerometers is that some three-axis accelerometers are not uniform in gain or output range in all three axes. For example, the Z axis may provide a different reading when pointing straight down than if the X or Y axes were so oriented. It is known that the sensitivity of each accelerometer channel is a function of the angle of the sensing axis to the direction of force. This sensitivity is related to the cosine projection of the force onto the axis. In other words, the axis is most sensitive, that is, it changes magnitude most responsively to force or angle change, when the direction of net force is nearly perpendicular to the sensing axis. When the sensed force is mostly aligned with the sensing axis, changes in force or angle have the least effect on the sensor output.

Figure 4A:
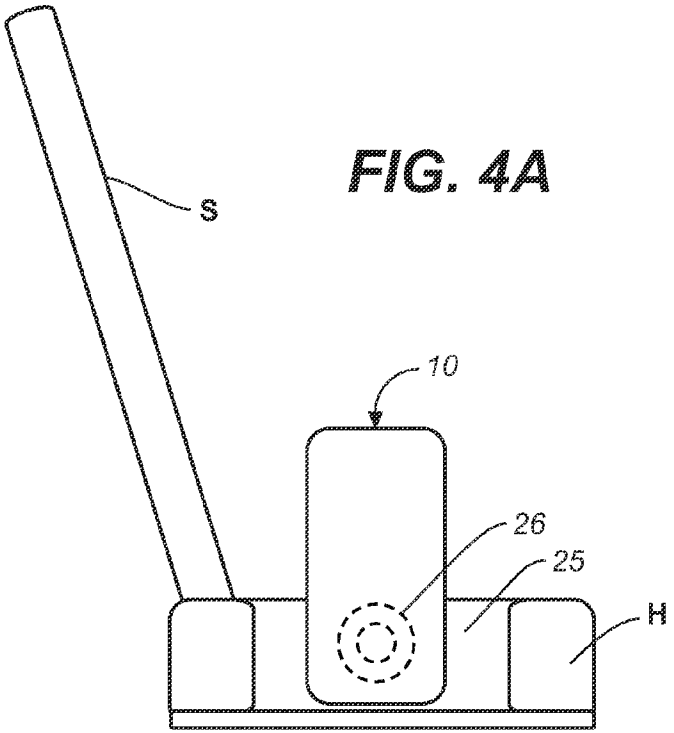
FIG. 4A is a rear elevational view of a short game training device attached to a ferrous cavity back putter.

With reference now to FIG. 4A, it is seen that the short game trainer 10 may be attached to the back 25 of a ferrous cavity-back putter using magnet 26. The player orients the device so that its longitudinal dimension L is in generally parallel alignment with vertical plane V containing aim line A at the moment the ball is addressed in preparation for the shot. Doing so positions the X and Y axes of the accelerometer at a 45° angle to vertical plane V, and aligns the Z axis with aim line A. See FIGS. 1A, 1B, 4A, 4B, and 5. Orientation of the X and Y axes at 45° to vertical provides some very important advantages as discussed below.

Figure 6:
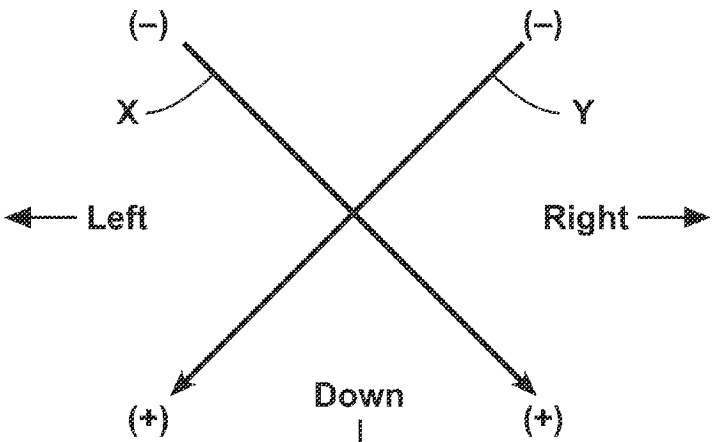
FIG. 6 is diagram of the X and Y axes of a linear accelerometer according to the invention showing the effect of right, left and down motion.
Figure 5:
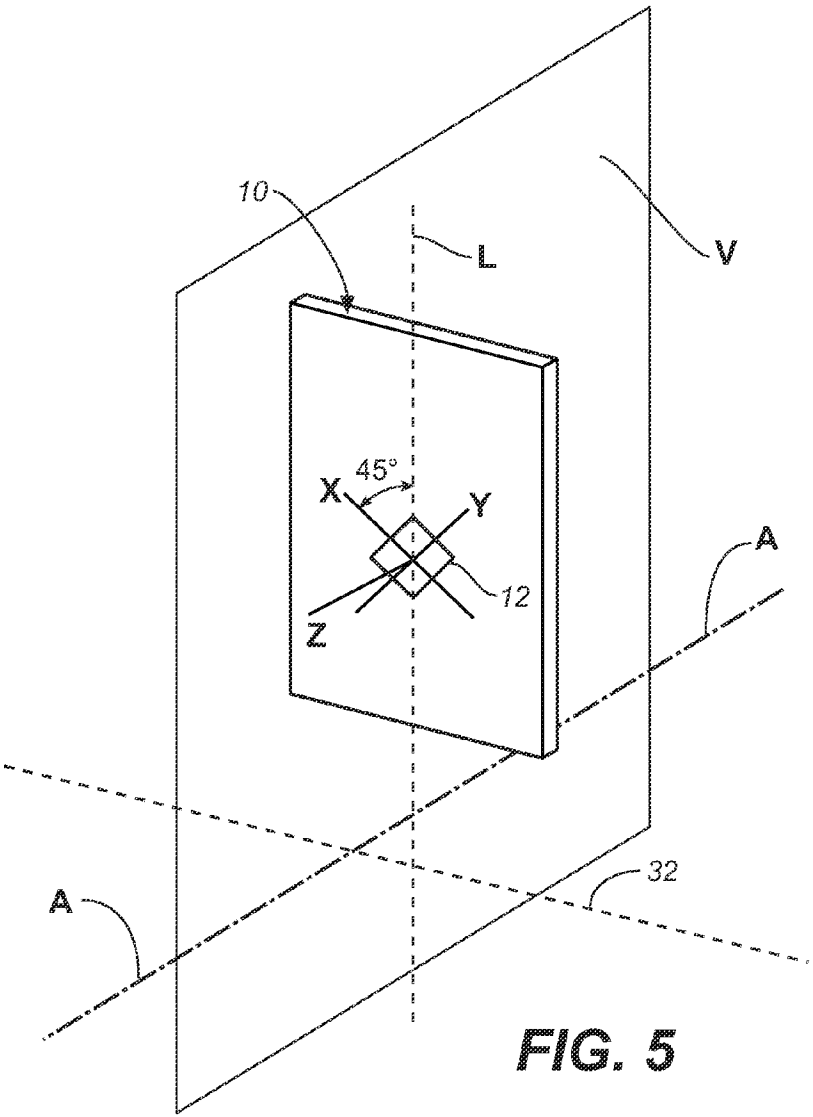
FIG. 5 is a simplified perspective schematic showing the relative position of the accelerometer of short game training device with respect to vertical, the address line, and the aim line.

In FIG. 5 it is seen that the accelerometer 12 is disposed at a 45° orientation with respect to vertical plane V. By placing the accelerometer in the above-described attitude, the force of gravity and forces generated along the Z axis will result in nearly identical measurements by both of the X and Y axes sensors. Similarly, any changes in magnitude of the projection of the force of gravity experienced by the accelerometer 12, such as result by moving the club head directly up or down, will generate nearly identical measurements by the X and Y axes sensors. Conversely, if the accelerometer experiences a force lateral to the vertical plane, one of the X and Y axes sensors will measure an increase in magnitude of force and the other will measure a decrease expressive of the polarity of each sensor. As shown in FIG. 6, if the club, and hence, the accelerometer moves to the right, the X axis sensor will register a negative measurement while the Y axis sensor will register a positive. However, if the club moves to the left, the X axis sensor will register a positive measurement while the Y axis sensor will register a negative. And, if the club moves directly downward, both X and Y sensors will register nearly identical negative measurement. Thus, if the club moves "outside," away from the player, or "inside," towards the player, this will cause the X and Y axes sensors to measure different magnitudes of force. The microprocessor is programmed to generate an error signal when it receives signals from the X and Y axes sensors indicating measurements of different force magnitudes.

Figure 7:
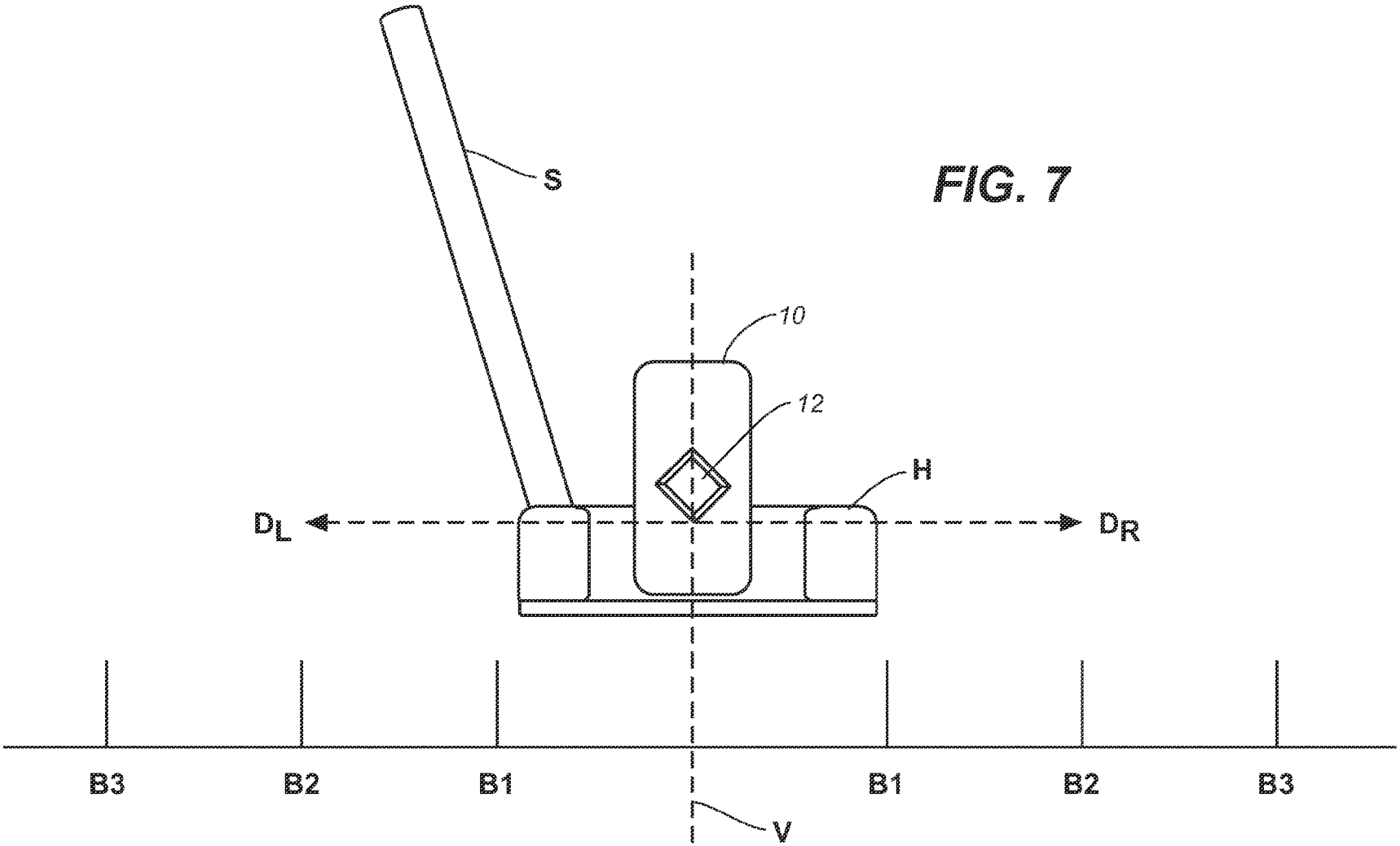
FIG. 7 is an elevational view of a putter with a short game training device attached with lateral error amplitude bounds indicated as corresponding to physical deviations from the aim line.

With reference now to FIG. 7, a golf club is shown to the club head H of which is attached a short game training device 10, including an accelerometer 12, according to the invention. Orientation of the X and Y axes of the accelerometer 12 as described above enables detection of lateral movement of the club in directions $D_L$ and $D_R$. It will be apparent to those of skill in the art that the accelerometer does not measure true ground position, but rather the amplitude of "error" based on the measured forces experienced by the X and Y axes sensors. Nevertheless, since the magnitude of the signal received from each axis sensor varies in proportion to the change in force it experiences, the amplitude of the error can be related to a defined path width B-B having vertical plane V at its center. The microprocessor is, therefore, programmed to recognize six amplitude bounds as error thresholds; each error threshold correlating with a unique path width B1-B1, B2-B2, B3-B3. Thus, as the club is swung through a stroke, if the selected threshold is exceeded, the microprocessor will cause the speaker 18 to sound an alarm. It will be understood that the choice of six thresholds is arbitrary and that the device may be programmed with more than or less than six thresholds. Selection of a threshold having a larger error amplitude correlates with a wider stroke path permitting the player greater latitude in practicing his or her stroke. Conversely, a player having a greater skill level or wishing to hone his or her skills may select a threshold having a smaller error amplitude correlating with a narrower stroke path.

In addition to sensing lateral movement of the club from the aim line, the short game training device will also recognize club face misalignment and toe-up and toe-down rotation. As indicated above, if the club face is perpendicular to the aim line A, such that the X and Y axes are also perpendicular to the aim line, movement of the club along the aim line will result in nearly identical force measurements by the X and Y axes. However, if the club face is open or closed such that the X and Y axes are not orthogonal to the aim line, small differences in force components will be registered by the X and Y axes sensors. Similarly, if the club is rotated about the Z axis, resulting in a "toe-up" or "toe-down" condition, the X and Y axes will experience differences in force magnitudes. The total difference in force measured by the X and Y axes due to lateral movement of the club, club face misalignment and toe-up and toe-down rotation are combined to determine if a selected error amplitude has been exceeded.

As the club swings through a stroke, it follows an arc as seen in FIG. 8A. This pendular motion results in a slight up and down motion M of the accelerometer about a horizontal axis (perpendicular to the aim line) and, as shown in FIG. 8B, slight rotation R of the accelerometer 12 about a vertical axis from beginning to end of the stroke. Both the up and down motion M and the rotation R cause the X and Y axes sensors to register nearly identical measurements which, since they do not contribute to the difference in force measured, are effectively ignored by the device.

Thus, by simply orienting the accelerometer such that the X and Y axes are inclined at 45° to vertical at the beginning of a short game stroke, less important club motions, such as its inherent pendular motion during a stroke, are ignored, while critical club position and movement such as club face alignment, lateral movement, and toe-up and toe-down rotation, are sensed. A collateral advantage of the 45° orientation is that the number of calculations that the microprocessor must perform is reduced because it is programmed only to take into account the differences in forces measured by the X and Y axes sensors. The device thus makes more efficient use of the processor which in turn results in longer battery life.

The 45° physical sensor orientation makes it possible to ignore the vertical forces of the club while sensing the lateral forces. In this orientation forces which do not contribute to lateral error effectively cancel during error signal calculation. This amounts to factoring out certain parts of the calculation which has the advantage of reducing the calculation load on the microprocessor. The 45 degree sensor orientation places the X and Y sensor axes so that the forces registered are of roughly equal magnitude and in similar points of sensitivity on each sensor's response curve. This eliminates needing to calculate normalized sensor scale readings before doing calculations based on both X and Y sensor values, that is, no arc-cosine calculations are required.

Both the cancellation and the reduction of arc-cosine calculations reduce the amount of calculation. The benefits of this reduced calculation load are:

- realtime error calculation—the simplicity of the error calculation allows realtime feedback during the stroke.
- reduced processor cost—the error calculation is performed without, for instance, multiplication. This means a less expensive processor chip is required to meet the realtime constraint. Also, the axis sensitivity calculation avoided saves arc-cosine calculations which could be done using table lookup. This could mean the processor would need less memory.
- reduced clock speed—by having a simpler error calculation, a blazingly fast processor is not required. Since fast clock speeds disproportionally increase power consumption and reduce battery life, this is an advantage.
- sensor calibration—the fact that calculations use differences between X and Y axis readings, not absolute values, allows for variation in sensor response from unit to unit. If selected threshold values were compared to absolute values of individual units, each would have to be assumed to be similar or would have to be individually tested to assure accuracy. This is avoided by effectively using differences in sensor values, advantageously yielding similar effects on both channels despite manufacturing variations.
- sensor response changes caused by battery voltage variation—the sensor is designed to work at and is calibrated for a specific voltage. As the battery ages and as different loads like the LED and speaker are imposed, the effective voltage on the sensor changes. By using differences between X and Y axis values, the variation in sensor absolute values caused by varying sensor voltage "cancel."

Figure 9:
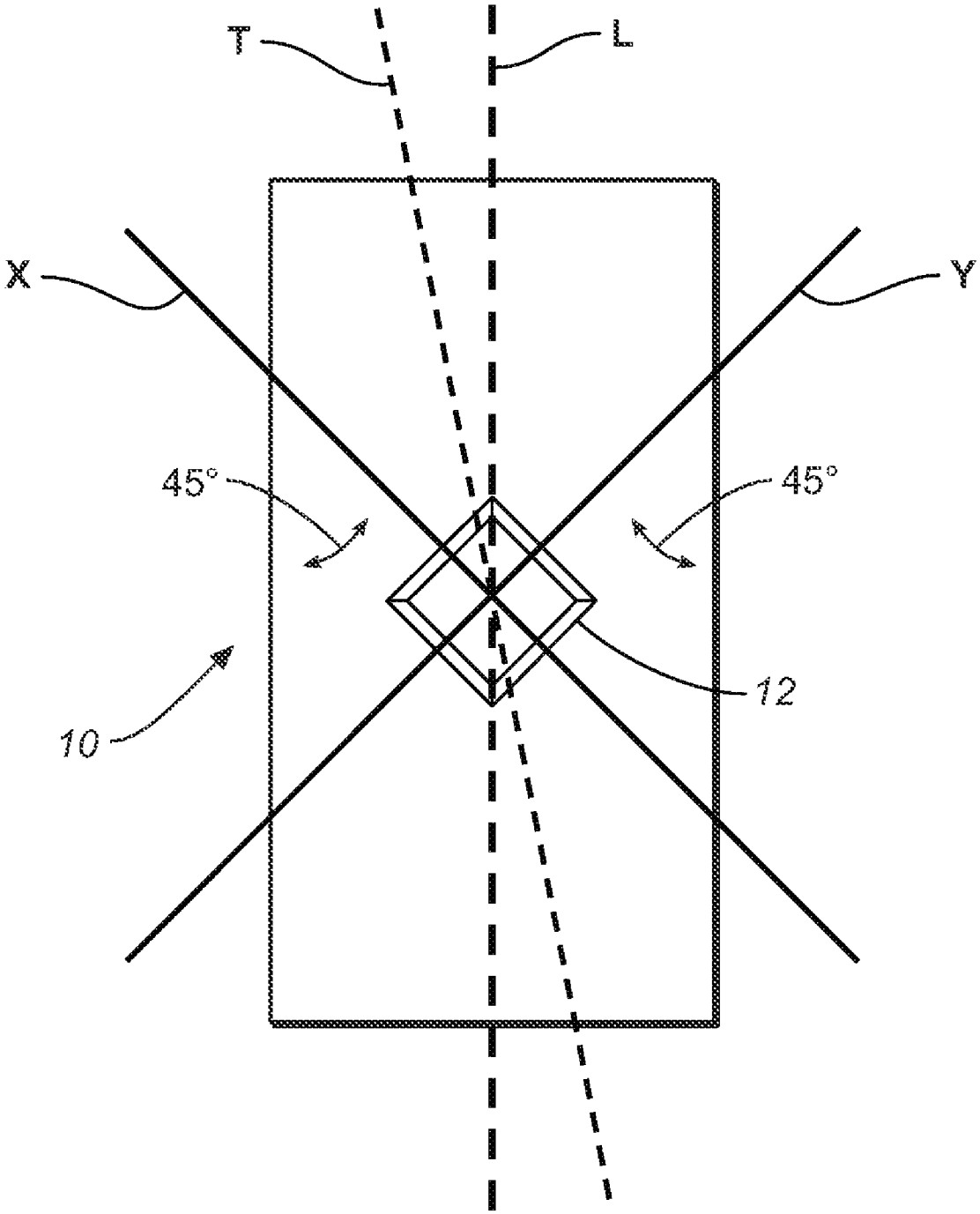
FIG. 9 is a simplified schematic representation of a short game training device showing the linear accelerometer positioned with the X and Y axes disposed at a 45° angle with respect to the longitudinal dimension of the device.

It will be recognized that it will be impossible to place the device on the club in such a way that the X and Y axes are perfectly aligned at 45° to vertical each time a ball is addressed. The short game training device is programmed to compensate for this anticipated misalignment as follows. When the ball is addressed and club movement stops, changes in force measurements by all three axes, X, Y and Z, will also stop. When the microprocessor recognizes that all three axes are thus "quiet," it will "set" by reading the force of gravity sensed by the X and Y axes sensors in order to determine the direction of true vertical. Determination of the direction of true vertical allows calculation of the angular deviation of the X and Y axes from the ideal 45° inclination to true vertical T. See FIG. 9. Thereafter, the calculated degree of angular deviation of the X and Y axes from the ideal 45° inclination is used to introduce a compensatory factor to correct force measurements taken from the X and Y axes sensors throughout the stroke. In this way the device compensates for inevitable positioning errors at the commencement of each practice stroke to deliver accurate error measurements during the stroke. As discussed above, this corrective calibration also compensates both for differences in the properties of individual sensor components saving manufacturing, testing and calibration costs, and changes in sensor response caused by changing sensor voltages resulting from aging batteries.

With reference again to FIG. 2A, the on/reset button 22 is used to turn the device on or reset it to initial conditions. The mode button 20 is used to move between practice modes, adjust practice difficulty levels, and turn the unit off. The major operating states of the device are "Off," "Bounded Error Mode" and "Continuous Tone Mode." Pressing the "On/reset" button causes the status light 16, preferably an LED, to light, indicating that the battery is holding a charge sufficient for operation. Releasing the "on" button causes a sequence of tones to be played which are indicative of three conditions which occur in "Bounded Error Mode" practice: a low-high tone pair, a high-low tone pair, and a single midrange tone. The low-HIGH tone pair is for indicating deviation out of limits in the "outside" direction. The high-LOW tone pair is for indicating deviation out of limits in the "inside" direction. The middle tone is for indicating that the error bounds were not exceeded during a stroke. Playing of the tonal sequences when the device is turned on serves both to verify that the speaker is working and to familiarize the player with the tones to expect during practice. Bounded Error Mode is entered directly after the tonal sequence is played.

Bounded Error Mode consists of two states which alternate based on a timed sequence: an "idle" state and a "stroke monitor" state. The idle state provides an interval of silence to allow the player to address the ball and become composed for the stroke. At the end of the interval, a wink of the status light 16 indicates entry into the stroke monitor state.

Figure 10:
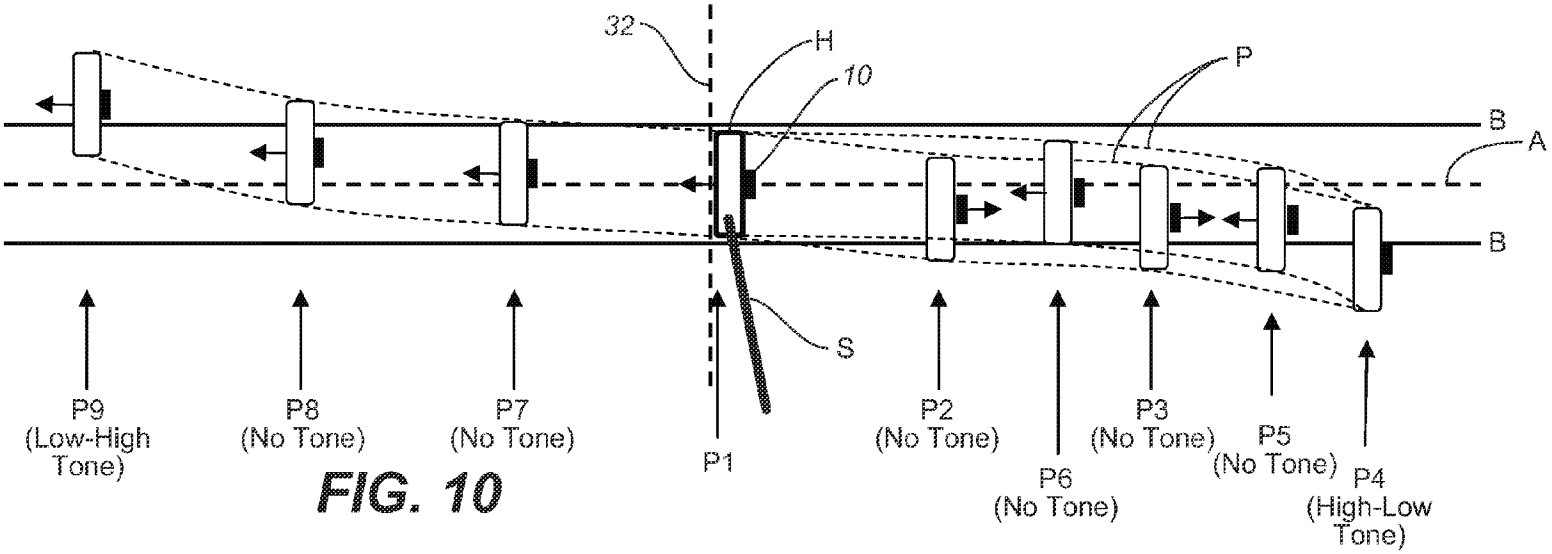
FIG. 10 is a plan view of a golf club with a short game training device attached passing through a stroke path and showing excess inside and outside lateral deviations from the aim line.

The stroke monitor state is a timed interval during which the accelerometer is sampled and club position errors are measured frequently. With reference to FIG. 10, the club head is positioned at address line 32 over aim line A when addressing the ball (not shown) at point P1. As the club is drawn backwards through path P for the back stroke it may pass through points P2 and P3. Since the lateral error amplitude boundary has not been exceeded, no tone will issue at these points. However, when the club reaches point P4, it is seen that the club has deviated inside far enough that the lateral error amplitude boundary B is exceeded causing a high-low tone to sound. During the down stroke the club passes through points P5, P6, P7 and P8 where its position is near enough the aim line A that the lateral error amplitude boundary B is not exceeded. Therefore, no tone sounds. However, at the end of the follow through, at point P9, the club veers outside causing a low-high tone to sound.

Figure 11:
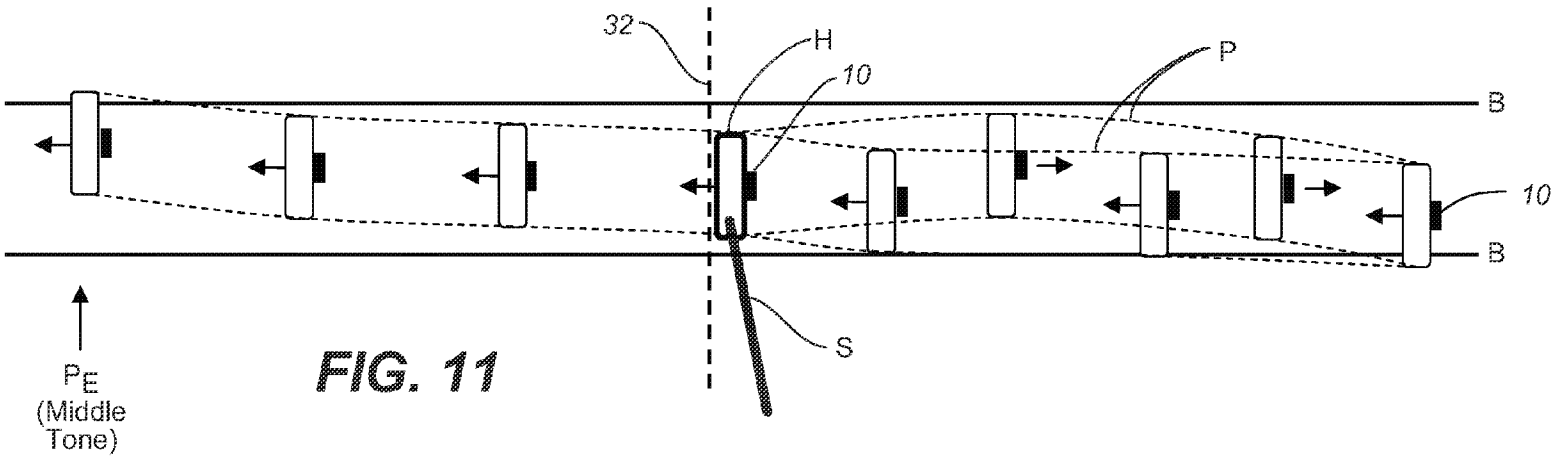
FIG. 11 is a plan view of a golf club with a short game training device attached passing through a stroke path showing more controlled lateral deviation from the aim line than shown in FIG. 10.

Considering now FIG. 11, it is seen that, although the club experiences lateral deviation during the take away, downstroke and follow through, at no point does the deviation exceed the error amplitude boundary B. Therefore, at the end of the stroke, at point $P_E$, a middle tone sounds rewarding the player for controlling club head deviation.

Pressing and releasing mode button 20 activates the Continuous Tone Mode. Continuous Tone Mode is heralded by two modulated tone sequences, one starting at a middle frequency tone, sweeping to a high frequency, and returning to the middle frequency tone, and a second starting at the middle frequency tone, going to a low frequency tone, and returning to the middle frequency tone. Continuous Tone Mode is entered directly after this tonal announcement. Similarly to Bounded Error Mode, Continuous Tone Mode alternates between an idle state and a stroke monitor state. In the stroke monitor state, however, the amplitude of deviation is monitored frequently and used to modulate the frequency of a continuously sounding tone. Thus, if the lateral deviation is zero, the middle frequency tone sounds. If the deviation tends to the outside, the frequency of the tone will vary higher in proportion to the magnitude of the deviation, up to a maximum high tone. Conversely, if the deviation tends to the inside, the frequency of the tone will vary lower in proportion to the magnitude of the deviation, down to a minimum low tone. If the lateral deviation is large, the variation in frequency of the tone will be limited by the maximum and minimum tones.

From Continuous Tone Mode, a single press and release of the mode button 20 turns the device off. If the device is not turned off after 20 minutes, or another specified duration, from the last time the mode button was pressed, it will enter the off state to preserve battery life.

Threshold settings are selected from "practice level setting" mode. Pressing the mode button 20 and holding it for at least two seconds from either the Bounded Error Mode or the Continuous Tone Mode results in activating practice level setting mode. Continuing to hold the mode button causes the practice level to change, each practice level representing a selected threshold corresponding to a higher or lower error amplitude boundary. Each new level is indicated by the LED 16 blinking a number of flashes according to the activated level. Thus practice level "1" will be indicated by one blink of the LED; practice level "4" by four blinks of the LED, and so forth. Releasing the mode button causes the indicated practice level to be retained. The lower the practice level number, the smaller will be the error that exceeds the error amplitude boundary. The default level is preferably set to one of the middle levels, e.g., 3 or 4. The expert may hone his or her skills at levels 1 or 2, while level 6 is more forgiving for the novice. The different practice level settings permit a user to progress to more difficult levels as skills improve. The device will cycle through practice levels in the following order until the button is released: 2, 1, 6, 5, 4, 3. The selected practice level will be retained until changed again or reset by pressing the on/reset button. A practice level that is selected during Bounded Error Mode will be retained if the practice mode is changed to Continuous Tone Mode.

If the mode button is pressed during either of the tone sequences which sound at the beginning of either the Bounded Error Mode or Continuous Tone Mode, the tone sequence will be silenced and the respective practice mode entered immediately upon release of the mode button. This allows an experienced device user to skip over these introductory sounds and proceed to practice without waiting for the tonal sequence to come to an end.

The utilities of the device described above may be implemented using a 2-axis accelerometer since only the X and Y axes are needed to monitor undesirable lateral deviation, club face misalignment, and toe-up and toe-down rotations. In each practice mode, the stroke monitoring state is timed so that force measurements are sampled when the interval begins. In a particularly preferred embodiment, a 3-axis accelerometer is used including the Z-axis. In this embodiment club head motion may be detected by monitoring forces experienced by the Z-axis. The practice mode described above is, therefore, modified to begin the stroke monitoring state after the LED 16 flashes and, thereafter, as soon as club head motion is detected by the Z-axis sensor.

Figure 12A:
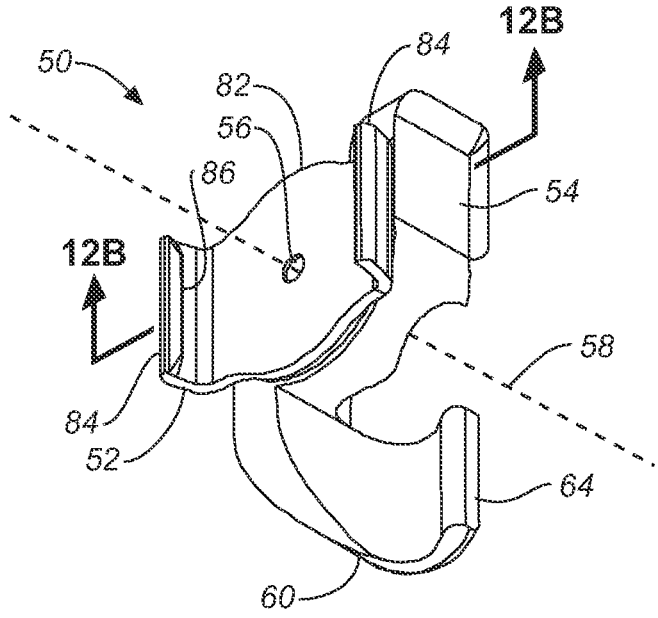
FIG. 12A is a perspective view of a fastener according to the invention for attaching the short game training device to a golf club shaft.
Figure 12B:
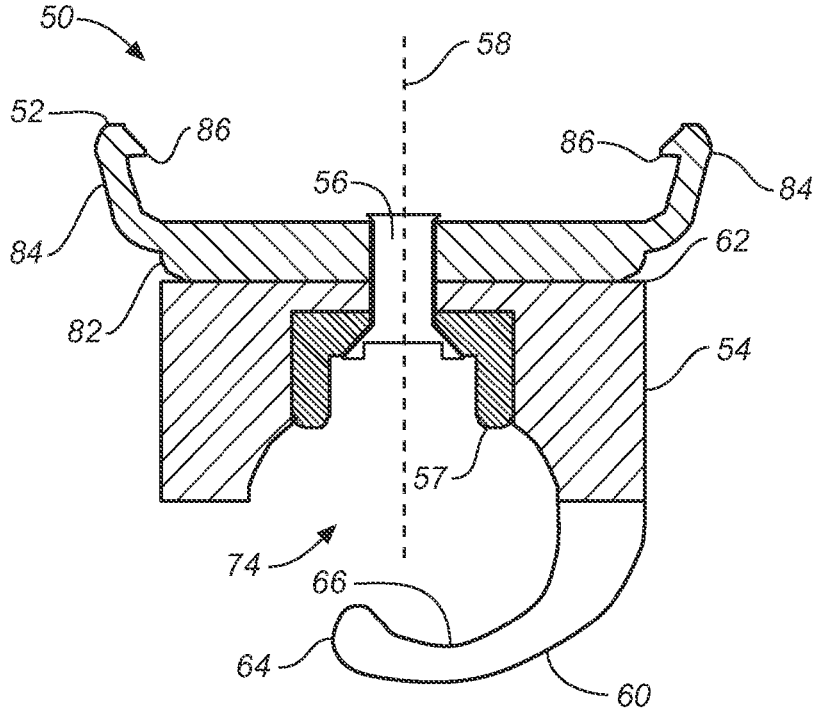
FIG. 12B is a sectional view of the fastener shown in FIG. 12A taken along line 11B-11B.
Figure 12C:
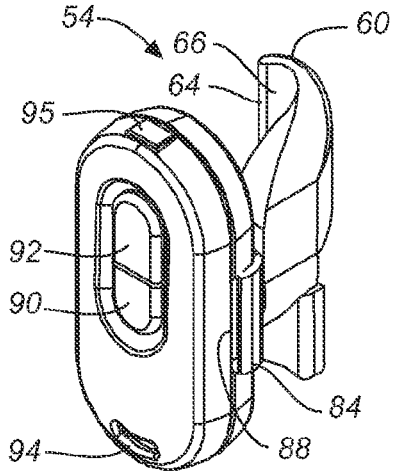
FIG. 12C is a perspective view of a housing for a short game training device according to the invention and the fastener shown in FIGS. 12A-11B.
Figure 12D:
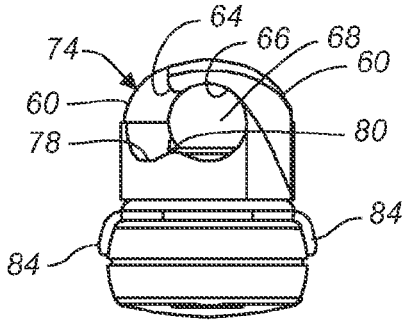
FIG. 12D is a top view of the housing and fastener shown in FIG. 12C.
Figure 12F:
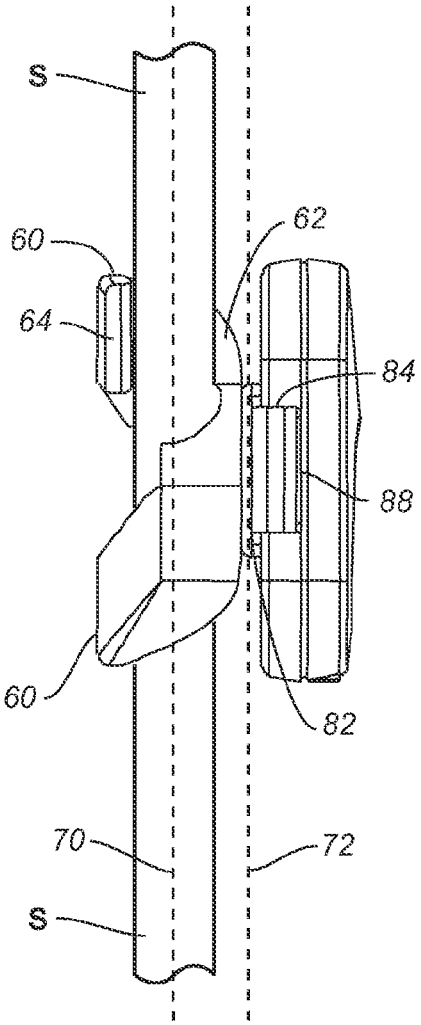
FIG. 12F is a side elevational view of the housing and fastener shown in FIG. 12C attached to a golf club shaft.
Figure 12E:
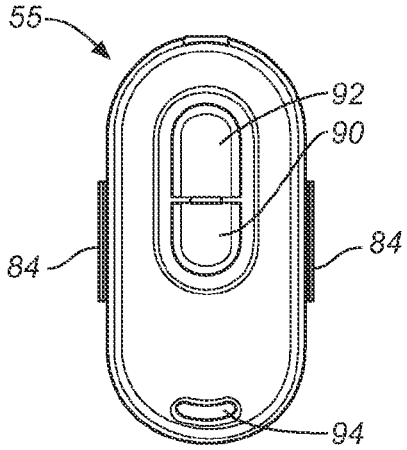
FIG. 12E is a front view of the housing shown in FIG. 12C.
Figure 16A:
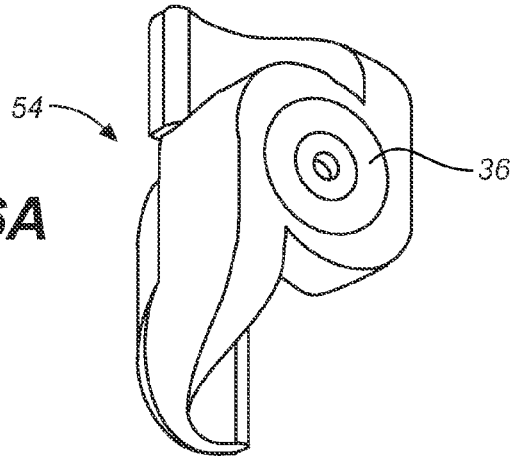
FIG. 16A is a perspective view of a magnetic clip fastener for attaching to a housing for a short game training device according to the invention.
Figure 16B:
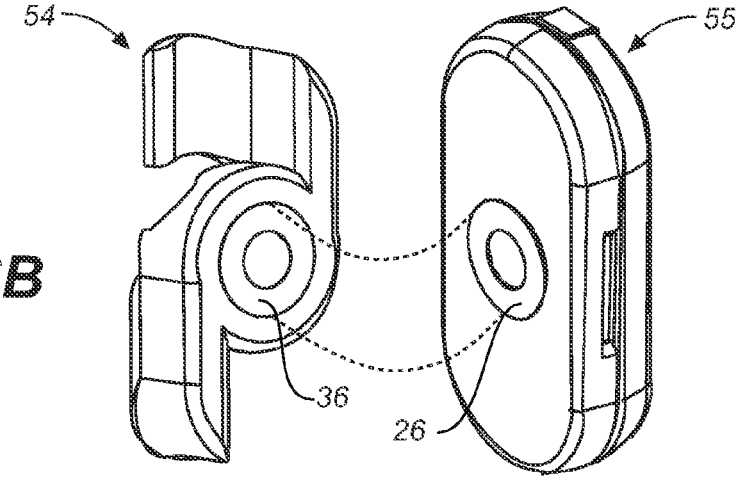
FIG. 16B is a perspective view of the fastener shown in FIG. 16A together with a cooperating housing for a short game training device according to the invention.

It will not always be possible or desirable to attach a short game training device according to the invention to a club head using a magnet. Therefore, a rotatably adjustable fastener 50 is provided as shown in FIGS. 12A-12B. Fastener 50 comprises caliper 52 and clip 54. The caliper 52 and clip 54 are rotatably interconnected about a rivet 56 and a flexible grommet 57 which form a pivot axis 58 and biases the caliper 52 and clip 54 together. In another embodiment (not illustrated) caliper 52 and clip 54 are rotatably attached with a rivet and spring assembly wherein the spring biases the housing and clip together. In a third embodiment shown in FIGS. 16A-16B, cooperating magnets 26, 36 are provided, respectively, on the housing 55 and clip 54.

Figure 13A:
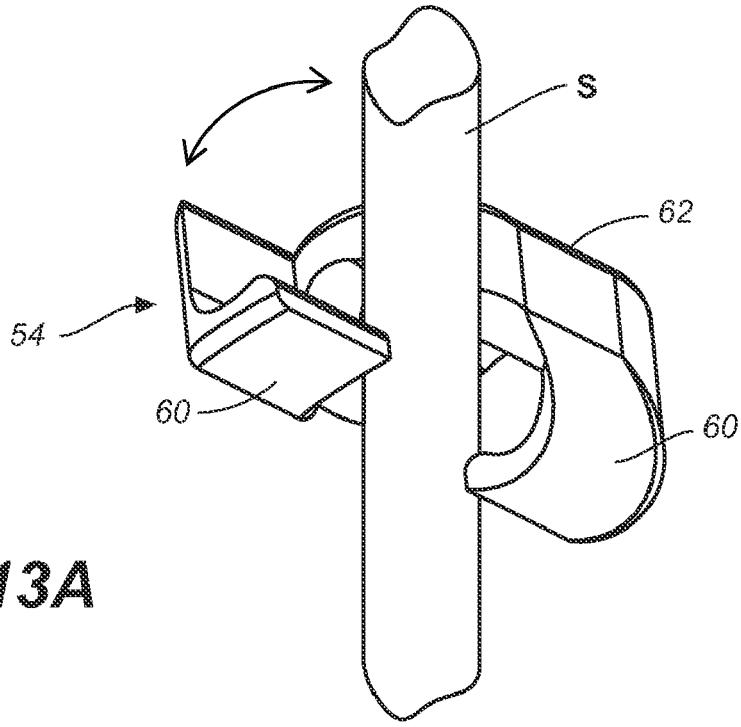
FIGS. 13A and 13B are perspective views showing attachment of the clip element of an alternate embodiment of a fastener for attaching the short game training device to a golf club shaft.
Figure 13B:
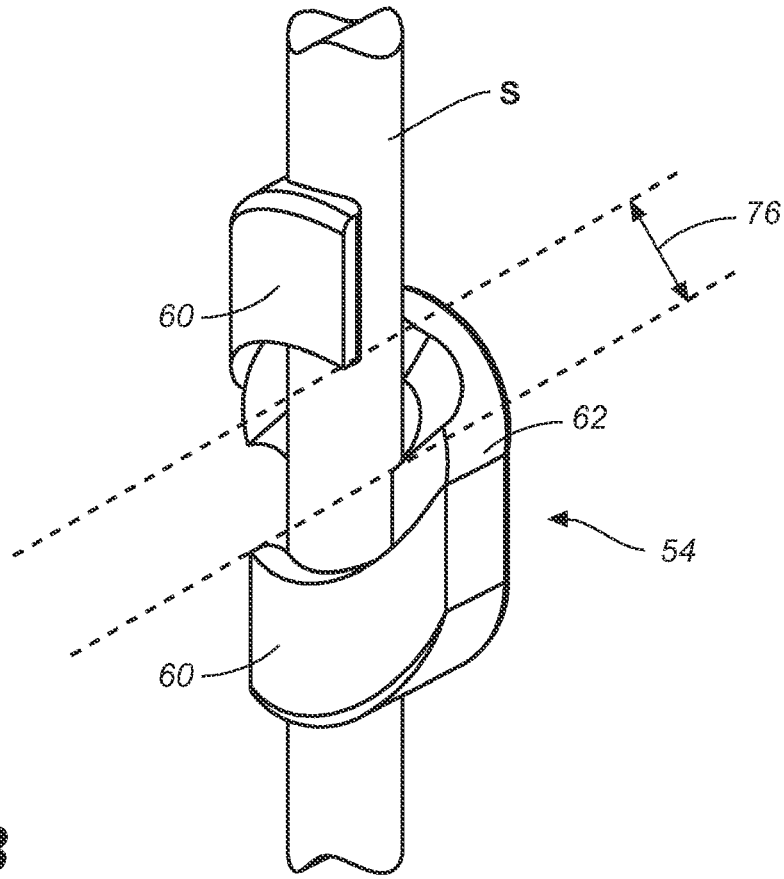

In the embodiment shown in FIGS. 12C-12F, two flexible arms 60 extend from a base portion 62 of the clip 54 to a free end 64. Each arm 60 has an arcuate inner surface 66 which forms part of a cylindrical channel 68, best seen in FIG. 12D, which is sized to receive the shaft S of a golf club. See also FIGS. 13A and 13B. The inner surfaces of each arm 60 are aligned along a common axis 70 which is parallel to the longitudinal dimension 72 of clip 54. Each arm 60 defines a mouth 74 between the free end 64 and the base portion 62 having a width slightly smaller than the diameter of shaft S. The mouths 74 face in opposite directions with respect to the longitudinal dimension 72 of the base portion 62 of clip 54 as shown best in FIGS. 12C and 12F. The arms 60 are also spaced apart a distance 76 at least as great as the diameter of shaft S. To attach the clip to shaft S, the shaft is inserted in the spacing between the two arms 60; the clip 54 is then rotated to move the shaft S through the mouths 74 into the apertures 68 of each arm 60 where it is firmly held parallel to the longitudinal dimension 72 of the base portion of the clip and, hence, perpendicular to pivot axis 58. See FIGS. 13A and 13B. Arms 60 are slightly flexible to enable mouths 74 to expand as shaft S is pushed into the aperture and to permit the shaft to be removed from the clip 54 by simply rotating it in the opposite direction than that used to attach it to the shaft. Preferably, the rear face 78 of the base portion is provided with a cam 80 which acts with the inside surface 66 of arms 60 to more completely surround and hold in place the golf club shaft once it has been inserted in arms 60. See FIG. 12D.

In the illustrated embodiment, rivet 56 is rotatably attached to the base portion 62 of the clip 54 and back plate 82 of rotatable caliper 52. See FIGS. 12A-12B. Dual opposed flanges 84 extend upwardly from the back plate 82 and opposed lips 86 project inwardly from the upper edges of the flanges 84 and are spaced from the back plate 82. Lips 86 snap into cooperating slots 88 in the side of housing 55. The housing 55 is thus firmly, but removably, affixed to back plate 82 of rotatable caliper 52 in perpendicular disposition to pivot axis 58 and, hence, rotatably affixed in parallel relation to base portion 62 of clip 54 and, importantly, to shaft S captured in the arms 60 of clip 54. In an alternate embodiment, the back plate 82 is an integral part of the housing 55 such that it is permanently joined with the clip 54.

The front of the housing 55 is provided with button plates 90 and 92 for activating the mode and on/reset buttons 20, 22. Opening 94 is aligned with speaker 18 to facilitate sound transmission from the speaker out of the housing 52. Port 95 is provided for emission of light from LED 16.

Figure 14:
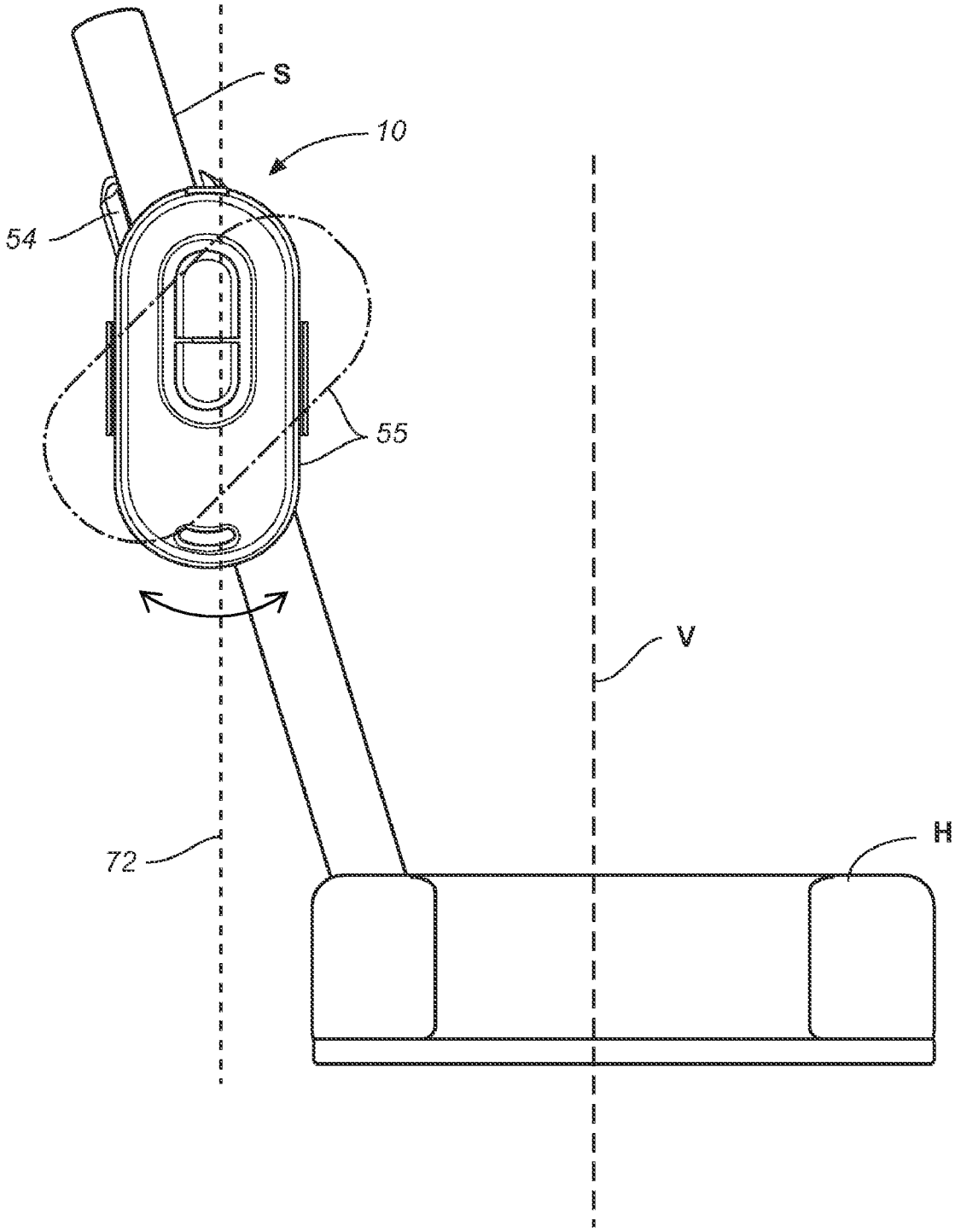
FIG. 14 is an elevational view of a short game training device attached to the shaft of a golf club with the fastener depicted in FIGS. 13A and 13B.

With reference now to FIG. 14, it is seen that the housing 55 has been affixed to a golf club shaft S using the fastener 50. The longitudinal dimension 72 of the base portion 62 of the clip 54 can be rotationally adjusted to a position estimated by the user to be aligned with vertical plane V when using the club to address the ball.

Figure 15A:
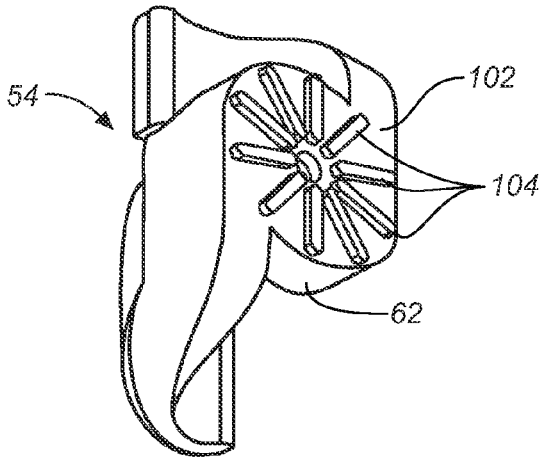
FIG. 15 is a perspective view of the clip depicted in FIGS. 13A and 13B showing multiple straie.
Figure 15B:
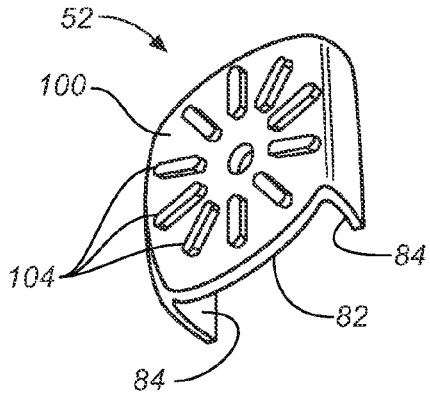

In one embodiment of the device, the back face 100 of the back plate 82 of the rotatable caliper 52 and the forward surface 102 of the base portion 62 of the clip 54 have cooperating sets of striae 104 extending radially from the axis of rotation formed by the rivet 56. See FIGS. 15A and 15B. Since the rivet 56 biases the back face 100 of the back plate 82 and forward surface 102 of the base portion 62 together, the striae cause sufficient mutual interference to hold the parts in place against rotational alignment even against the forces experienced as a result of practicing with the club. However, the rivet 56 is seated in grommet 57 (as shown in FIG. 12B) which is sufficiently elastic that rotational movement of the back plate 82 and base portion 62 may be overcome by rotating the housing 55 by hand to a desired new position. It will be appreciated by those of skill in the art that there are many ways to establish mutually resistant surfaces that are in rotational abutment. One embodiment of the device could use a bump and dimple arrangement in which an array of bumps are arranged on one of the surfaces and a cooperating array of dimples on the other. Another embodiment could employ roughened surfaces to establish a sufficient degree of traction.

There have thus been described certain preferred embodiments of a short game training device for use with a golf club. While preferred embodiments have been described and disclosed, it will be recognized by those with skill in the art that modifications are within the true spirit and scope of the invention. The appended claims are intended to cover all such modifications.

We claim:

1. A short game training device for use with a golf club, the golf club having a club face for striking a golf ball, the short game training device comprising:

an accelerometer having at least two axes including an X-axis and a Y-axis orthogonal to said X-axis, each of said X and Y axes capable of measuring linear forces experienced along their respective axes, and each of said X and Y axes having a polarity such that forces experienced in one direction along each one of said axes are registered as a positive value and forces experienced in the opposite direction along said axes are registered as a negative value, a fastener for removably attaching said accelerometer to a golf club so that said X and Y axes are each approximately in parallel alignment with the club face, and so that said X and Y axes are each disposed at approximately a 45° angle with respect to a substantially vertical plane when positioning the golf club to address the golf ball with the club face aligned perpendicularly to a selected aim line, said vertical plane parallel to said aim line, the polarity of both of said X and Y axes pointed either upward or downward such that horizontal movement lateral to said aim line will register as a positive measurement on one of said X and Y axes and as a negative measurement on the other of said X and Y axes a detectable alarm, and a microprocessor for calculating differences in the values of the forces measured by said X and Y axes during a timed interval after the golf ball has been addressed by the golf club, said timed interval commencing with the beginning of a stroke of the golf club, and for activating said alarm during said timed interval when said differences indicate lateral movement relative to said aim line.

2. The short game training device of claim 1 wherein:

said at least two axes includes a Z-axis orthogonal to said X and Y axes.

3. The short game training device of claim 2 wherein:

said accelerometer is capable of measuring acceleration of said club face in said Z-axis.

4. The short game training device of claim 3 wherein:

said microprocessor is capable of beginning said timed interval when movement of said club face is indicated by detection of acceleration in said Z-axis.

5. The short game training device of claim 2 wherein:

said microprocessor is capable of beginning said timed interval a selected time period after changes in linear forces in said X, Y, and Z axes have substantially ceased.

6. The short game training device of claim 1 wherein:

said fastener comprises a magnet.

7. The short game training device of claim 1 wherein:

said alarm is selected from the group consisting of audible, visual, and vibratory alarms.

8. The short game training device of claim 1 wherein:

when said lateral movement in a first direction is indicated, said microprocessor directs said alarm to sound a first tonal sequence if said differences exceed said selected threshold, and when said lateral movement in a second direction is indicated, said second direction opposite to said first direction, said microprocessor directs said alarm to sound a second tonal sequence if said differences exceed said selected threshold.

9. The short game training device of claim 8 wherein:

said first tonal sequence having a "low-high" tonal sequence including a low tone and a high tone sounding subsequently to said low tone, said high tone having a higher frequency than said low tone, and said second tonal sequence having a "high-low" tonal sequence including said high tone and said low tone, said low tone sounding subsequently to said high tone.

10. The short game training device of claim 9 wherein:

when said lateral movement in said first and second directions does not exceed said selected threshold during said timed interval, said microprocessor directs said alarm to sound a middle tone, said middle tone having a frequency between said high and low tones.

11. The short game training device of claim 1 wherein:

when said lateral movement in a first direction is indicated, said microprocessor directs said alarm to sound a continuous first modulated tone if said differences exceed said selected threshold, said first modulated tone proceeding from a middle tone to a high tone in proportion to the force differences measured, and when said lateral movement in a second direction is indicated, said second direction opposite to said first direction, said microprocessor directs said alarm to sound a continuous second modulated tone if said differences exceed said selected threshold, said second modulated tone proceeding from a middle tone to a low tone in proportion to the force differences measured.

12. The short game training device of claim 1 further comprising:

said microprocessor being capable of activating said alarm at the beginning of said timed interval.

13. The short game training device of claim 12 wherein:

said alarm is an LED.

14. The short game training device of claim 12 wherein:

said microprocessor is capable of alternating between an idle state and said timed interval, said alarm being inactive during said idle state.

15. The short game training device for use with a golf club of claim 1 wherein:

said alarm is activated when said differences exceed a selected threshold.

16. The short game training device of claim 15 wherein:

said threshold is adjustable to a plurality of settings.

17. A short game training device for use with a golf club, the golf club having a club face for striking a golf ball, the short game training device comprising:

an accelerometer having at least two axes, said accelerometer capable of measuring linear forces in each of said axes, said axes including an X-axis and a Y-axis, said Y-axis orthogonal to said X-axis, a fastener for removably attaching said accelerometer to a golf club so that said X and Y axes are each approximately in parallel alignment with the club face, and so that said X and Y axes are each disposed at approximately a 45° angle with respect to a substantially vertical plane when positioning the golf club to address the golf ball with the club face aligned perpendicularly to a selected aim line, said vertical plane parallel to said aim line, a detectable alarm, and a microprocessor that calculates differences in forces measured by said X and Y axes during a timed interval subsequent to said positioning, and that activates said alarm when said differences exceed a selected threshold, wherein, upon said positioning of the golf club, said microprocessor detects a deviation in disposition of said X and Y axes from said 45° angle and biasing biases values derived from measurements of the forces by said X and Y axes during said timed interval to compensate for said deviation.

18. A short game training device for use with a golf club, the golf club having a club face for striking a golf ball and having a cylindrical shaft having a diameter, the short game training device comprising:

an accelerometer having at least two axes, said accelerometer capable of measuring linear forces in each of said axes, said axes including an X-axis and a Y-axis, said Y-axis orthogonal to said X-axis, a fastener including a housing and a clip, said housing rotatably affixed to said clip about a pivot axis, said accelerometer disposed in said housing with said X and Y axes in orthogonal relation to said pivot axis, said clip having a base portion and two flexible arms extending from said base portion, said base portion having a longitudinal dimension perpendicular to said pivot axis, each said arm defining a partial cylindrical aperture for receiving the golf club shaft, said apertures aligned along a common axis parallel to said longitudinal dimension, each said arm defining a mouth slightly smaller than the diameter of the golf club shaft, said mouths opening in opposite directions, said arms spaced from each other along said longitudinal dimension by at least the diameter of the golf club shaft, such that with the golf club shaft interposed between said arms rotation of said clip will cause the golf club shaft to move through said mouths to be captured by said arms in said apertures for removable attachment of said golf club shaft to said housing, said fastener for removably attaching said accelerometer to a golf club so that said X and Y axes are each approximately in parallel alignment with the club face, and so that said X and Y axes are each disposed at approximately a 45 angle with respect to a substantially vertical plane when positioning the golf club to address the golf ball with the club face aligned perpendicularly to a selected aim line, said vertical plane parallel to said aim line, a detectable alarm, and a microprocessor for calculating differences in forces measured by said X and Y axes during a timed interval subsequent to said positioning, and for activating said alarm when said differences exceed a selected threshold.

19. The short game training device of claim 18 the golf club shaft having an outer surface, wherein:

each said clip has an arcuate inner surface substantially conforming to the outer surface of the golf club shaft.

20. The short game training device of claim 19 wherein:

said arcuate inner surface has a distal portion generally opposing said base portion, said distal portion having an apex coincident with a plane longitudinally bisecting said base portion, said distal portion extending on both sides of said apex.

21. The short game training device of claim 18 wherein:

said base portion having a rear face, said rear face having a longitudinally extending arcuate surface substantially conforming to the outer surface of the golf club shaft.

22. The short game training device of claim 18 wherein:

said housing has a back plate having a generally planar back surface, said base portion of said clip has a generally planar forward surface, said back surface in rotating abutment with said forward surface, and a pivot mechanism is rotatably affixed to said back plate of said housing and to said base portion of said clip, said pivot mechanism defining said pivot axis, said pivot mechanism flexible along said pivot axis for biasing said back surface and said forward surface together.

23. The short game training device of claim 22 wherein:

said back surface and said forward surface each having cooperating rotationally resistant surfaces such that said housing may be retained in a selected angular relation to said clip.

24. The short game training device of claim 23 wherein:

said rotationally resistant surfaces include sets of striae extending radially from said pivot mechanism.

25. The short game training device of claim 23 wherein:

wherein said pivot mechanism comprises an elastic grommet.

26. The short game training device of claim 18 further comprising:

has housing having a first magnet, said clip having a second magnet for abutting said first magnet for rotatably affixing said clip to said housing, said first and second magnets forming said pivot axis.

27. A short game training device for use with a golf club, the golf club having a club face for striking a golf ball and a cylindrical shaft, the shaft having a diameter and an outer surface, the short game training device comprising:

an accelerometer having at least two axes, said accelerometer capable of measuring linear forces in each of said axes, said axes including an X-axis and a Y-axis, said Y-axis orthogonal to said X-axis, a fastener including a housing, a clip, and an elastic pivot mechanism, said housing having a back plate having a generally planar back surface, said clip having a base portion having a generally planar forward surface, said elastic pivot mechanism rotatably affixed to said back plate and to said base portion for rotatably affixing said housing to said clip about a pivot axis defined by said pivot mechanism, said accelerometer disposed in said housing with said X and Y axes in orthogonal relation to said pivot axis, said back surface and said forward surface each having cooperating sets of striae extending radially from said pivot mechanism, said pivot mechanism biasing said back surface and said forward surface together, such that said housing may be retained in a selected angular relation to said clip, said clip having two flexible arms extending from said base portion, said base portion having a longitudinal dimension perpendicular to said pivot axis, each said arm defining a partial cylindrical aperture for receiving the golf club shaft, said apertures aligned along a common axis parallel to said longitudinal dimension, each said arm defining a mouth slightly smaller than the diameter of the golf club shaft, said mouths opening in opposite directions, said arms spaced from each other along said longitudinal dimension by at least the diameter of the golf club shaft, such that with the golf club shaft interposed between said arms rotation of said clip will cause the golf club shaft to move through said mouths to be captured by said arms in said apertures for removable attachment of said golf club shaft to said housing, said fastener for removably attaching said accelerometer to a golf club so that said X and Y axes are each approximately in parallel alignment with the club face, and so that said X and Y axes are each disposed at approximately a 45 angle with respect to a substantially vertical plane when positioning the golf club to address the golf ball with the club face aligned perpendicularly to a selected aim line, said vertical plane parallel to said aim line, a detectable alarm, and a microprocessor for calculating differences in forces measured by said X and Y axes during a timed interval subsequent to said positioning, and for activating said alarm when said differences exceed a selected threshold.

28. A method for short game training using a golf club, the golf club having a club face, the method comprising:

attaching an accelerometer having at least orthogonally related X and Y axes to a golf club so that said X and Y axes are each in parallel alignment with the club face, each of said X and Y axes capable of measuring linear forces experienced along their respective axes, addressing a golf ball with the golf club so that said X and Y axes are each disposed approximately at a 45 angle with respect to a vertical plane that is parallel to a selected aim line associated with the golf ball, each of said X and Y axes having a polarity such that forces experienced in one direction along each one of said axes are registered as a positive value and forces experienced in the opposite direction along said axes are registered as a negative value, pointing said polarity of both said X and Y axes either downward or upward such that horizontal movement lateral to said aim line will register as a positive measurement on one of said X and Y axes and as a negative measurement on the other of said X and Y axes, measuring the forces experienced by each of said X and Y axes during a timed interval commencing with movement of the golf club to begin a stroke, calculating the amount of lateral horizontal deviation from the aim line during said timed interval based on the forces measured by said X and Y axes, and activating a detectable alarm during said timed interval responsive to said deviation.

* * * * *